US006857945B1

(12) United States Patent
Chen et al.

(10) Patent No.: US 6,857,945 B1
(45) Date of Patent: Feb. 22, 2005

(54) MULTI-CHAMBER CARRIER HEAD WITH A FLEXIBLE MEMBRANE

(75) Inventors: Hung Chih Chen, San Jose, CA (US); Steven M. Zuniga, Soquel, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/712,389

(22) Filed: Nov. 13, 2000

Related U.S. Application Data

(60) Provisional application No. 60/200,641, filed on Jul. 25, 2000.

(51) Int. Cl.[7] ..... B24B 29/00
(52) U.S. Cl. ..... 451/288; 451/398
(58) Field of Search ..... 451/285, 286, 451/287, 288, 397, 398, 388, 41

(56) References Cited

U.S. PATENT DOCUMENTS

| | | | | |
|---|---|---|---|---|
| 4,373,991 A | | 2/1983 | Banks | |
| 4,918,869 A | | 4/1990 | Kitta | |
| 5,081,795 A | | 1/1992 | Tanaka et al. | |
| 5,193,316 A | | 3/1993 | Olmstead | |
| 5,205,082 A | | 4/1993 | Shendon et al. | |
| 5,230,184 A | | 7/1993 | Bukhman | |
| 5,423,558 A | | 6/1995 | Koeth et al. | |
| 5,423,716 A | | 6/1995 | Strasbaugh | |
| 5,441,444 A | | 8/1995 | Nakajima | |
| 5,443,416 A | | 8/1995 | Volodarsky et al. | |
| 5,449,316 A | | 9/1995 | Strasbaugh | |
| 5,476,414 A | | 12/1995 | Hirose et al. | |
| 5,498,199 A | | 3/1996 | Karlsrud et al. | |
| 5,584,751 A | | 12/1996 | Kobayashi et al. | |
| 5,624,299 A | | 4/1997 | Shendon | |
| 5,643,053 A | | 7/1997 | Shendon | |
| 5,643,061 A | | 7/1997 | Jackson et al. | |
| 5,738,574 A | | 4/1998 | Tolles et al. | |
| 5,759,918 A | | 6/1998 | Hoshizaki et al. | |
| 5,762,539 A | | 6/1998 | Nakashiba et al. | |
| 5,762,544 A | | 6/1998 | Zuniga et al. | |
| 5,803,799 A | | 9/1998 | Volodarsky et al. | |
| 5,851,136 A | * | 12/1998 | Lee | 451/9 |
| 5,851,140 A | | 12/1998 | Barns et al. | |
| 5,879,220 A | | 3/1999 | Hasegawa et al. | |
| 5,957,751 A | | 9/1999 | Govzman et al. | |
| 5,964,653 A | * | 10/1999 | Perlov et al. | 451/288 |
| 6,056,632 A | | 5/2000 | Mitchel et al. | |
| 6,080,050 A | | 6/2000 | Chen et al. | |
| 6,110,026 A | | 8/2000 | Arai | |
| 6,116,992 A | | 9/2000 | Prince | |
| 6,157,078 A | | 12/2000 | Lansford | |
| 6,159,079 A | * | 12/2000 | Zuniga et al. | 451/41 |
| 6,162,116 A | | 12/2000 | Zuniga et al. | |
| 6,241,593 B1 | * | 6/2001 | Chen et al. | 451/288 |
| 6,291,253 B1 | | 9/2001 | Lansford et al. | |
| 6,390,905 B1 | * | 5/2002 | Korovin et al. | 451/286 |
| 6,422,927 B1 | * | 7/2002 | Zuniga | 451/288 |
| 6,612,903 B2 | | 9/2003 | Korovin et al. | |

FOREIGN PATENT DOCUMENTS

| | | |
|---|---|---|
| DE | 86 31 087.9 | 4/1987 |
| EP | 0 156 746 A1 | 10/1985 |
| EP | 0 653 270 A1 | 5/1995 |

(List continued on next page.)

OTHER PUBLICATIONS

U.S. patent application Ser. No. 09/470,820.

*Primary Examiner*—Dung Van Nguyen
(74) *Attorney, Agent, or Firm*—Fish & Richardson

(57) ABSTRACT

A carrier head that has a base assembly and a flexible membrane. The flexible membrane has a generally circular main portion with a lower surface that provides a substrate-mounting surface and a plurality of concentric annular portions extending from the main portion and secured to the base assembly. The volume between the base assembly and the flexible membrane forming a plurality of pressurizable chambers.

27 Claims, 5 Drawing Sheets

FOREIGN PATENT DOCUMENTS

| | | |
|---|---|---|
| EP | 0 841 123 A1 | 5/1998 |
| JP | 61-25768 | 2/1986 |
| JP | 63-114870 | 5/1988 |
| JP | 63-300858 | 12/1988 |
| JP | 1-216768 | 8/1989 |
| JP | 2-224263 | 9/1990 |
| JP | 2-243263 | 9/1990 |
| JP | 05 277929 | 10/1993 |
| WO | WO 96/36459 | 11/1996 |
| WO | WO 99/02304 A | 1/1999 |
| WO | WO 99/07516 | 2/1999 |
| WO | WO 99/33613 A | 7/1999 |
| WO | WO/00/13851 | 3/2000 |
| WO | WO 01/74534 A2 | 10/2001 |

* cited by examiner

MULTI-CHAMBER CARRIER HEAD WITH A FLEXIBLE MEMBRANE

This application claims benefit of Provisional application 60/200,641 filed Jul. 25, 2000.

BACKGROUND

The present invention relates generally to chemical mechanical polishing of substrates, and more particularly to a carrier head for use in chemical mechanical polishing.

An integrated circuit is typically formed on a substrate by the sequential deposition of conductive, semiconductive or insulative layers on a silicon wafer. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier or polishing head. The exposed surface of the substrate is placed against a rotating polishing disk pad or belt pad. The polishing pad can be either a "standard " pad or a fixed-abrasive pad. A standard pad has a durable roughened surface, whereas a fixed-abrasive pad has abrasive particles held in a containment media. The carrier head provides a controllable load on the substrate to push it against the polishing pad. A polishing slurry, including at least one chemically-reactive agent, and abrasive particles if a standard pad is used, is supplied to the surface of the polishing pad.

SUMMARY

In one aspect, the invention is directed to a carrier head that has a housing to be secured to a drive shaft, a base assembly, a loading chamber controlling the position of the base assembly relative to the housing, and a flexible membrane. The flexible membrane has a generally circular main portion with a lower surface that provides a substrate-mounting surface and a plurality of concentric annular flaps secured to the base assembly. The volume between the base assembly and the flexible membrane forms a plurality of pressurizable chambers.

Implementations of the invention may include one or more of the following features. A retaining ring may be joined to the base assembly. The carrier head may include five pressurizable chambers. Each chamber may control a downward pressure by an associated segment of the main portion of the flexible membrane on a substrate. At least one of the annular flaps may include a notch. The notch may be formed at a juncture between the at least one annular flap and the main portion. At least one of the annular flaps may include a widened section adjacent a juncture between the at least one annular flap and the main portion. The at least one annular flap may includes a horizontal portion extending from the base assembly to the widened section.

In another aspect, the invention is directed to a carrier head that has a base assembly and a flexible membrane. The flexible membrane has a generally circular main portion with a lower surface that provides a substrate-mounting surface and a plurality of concentric annular portions extending from the main portion and secured to the base assembly. The volume between the base assembly and the flexible membrane forms a plurality of pressurizable chambers.

In another aspect, the invention is directed to a method of sensing the presence of a substrate. A first chamber of a plurality of chambers in a carrier head is evacuated. The carrier head includes a base assembly and a flexible membrane main portion with a lower surface that provides a substrate-mounting surface and a plurality of concentric annular portions extending from the main portion and secured to a base assembly of a carrier head. The volume between the base assembly and the flexible membrane forms the plurality of pressurizable chambers. A pressure in second one of the plurality of chambers is measured, and whether the substrate is attached to the substrate-mounting surface is determined from the measured pressure.

Implementations of the invention may include one or more of the following features. Determining whether the substrate is attached to the substrate-mounting surface may include comparing the measured pressure to a threshold. The substrate may be determined to be present if the measured pressure is greater than the threshold.

Implementations of the invention may include one or more of the following features. Determining whether the substrate is attached to the substrate-mounting surface may include comparing the measured pressure to a threshold. The substrate may be determined to be present if the measured pressure is greater than the threshold.

In another aspect, the invention is directed to a carrier head with a base assembly and a flexible membrane. The flexible membrane has a plurality of concentric annular portions extending from the main portion and secured to the base assembly, at least one of which includes a notch. The flexible membrane has a generally circular main portion with a lower surface that provides a substrate-mounting surface. The volume between the base assembly and the flexible membrane forms a plurality of pressurizable chambers, Implementations of the invention may include one or more of the following features. The notch may be formed at a juncture between the at least one annular portion and the main portion. The at least one annular portion may include a plurality of notches. A first notch of the plurality of notches may be formed at a juncture between the at least one annular portion and the main portion, and a second notch of the plurality of notches may be formed at about a mid-point of the annular portion.

In another aspect, the invention is directed to a carrier head with a base assembly and a flexible membrane. The flexible membrane has a generally circular main portion, an outer annular portion, and an inner annular portion that includes a notch. The main portion has a lower surface that provides a substrate-mounting surface. The outer annular portion extends from an edge of the main portion and secured to the base assembly. The inner annular portion extends from the main portion and is secured to the base assembly, the volume between the base assembly and the flexible membrane forming a plurality of pressurizable chambers.

In another aspect, the invention is directed to a carrier head that has a base assembly and a flexible membrane. The flexible membrane has a generally circular main portion, an outer annular portion, and an inner annular portion that includes a widened section adjacent a juncture between the inner annular portion and the main portion. The main portion has a lower surface that provides a substrate-mounting surface. The outer annular portion extends from an edge of the main portion and is secured to the base assembly. The inner annular portion extends from the main portion is secured to the base assembly, the volume between the base assembly and the flexible membrane forming a plurality of pressurizable chambers.

DETAILED DESCRIPTION

Figure 1:
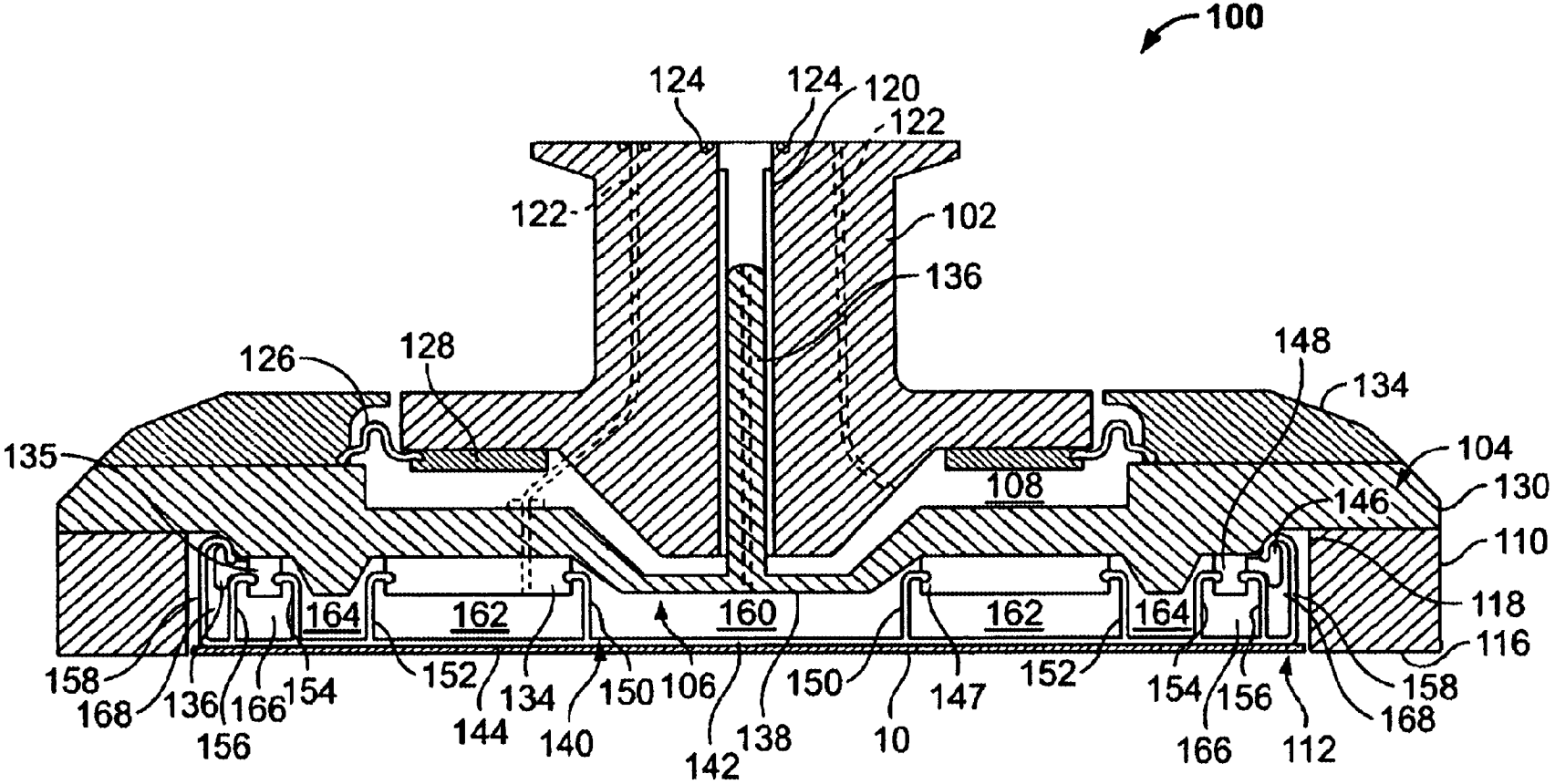
FIG. 1 is a cross-sectional view of a carrier head according to the present invention.

Referring to FIG. 1, the carrier head 100 includes a housing 102, a base assembly 104, a gimbal mechanism 106 (which may be considered part of the base assembly), a loading chamber 108, a retaining ring 110, and a substrate backing assembly 112 which includes five pressurizable chambers. A description of a similar carrier head may be found in U.S. patent application Ser. No. 08/861,260, filed May 21, 1997, the entire disclosure of which is incorporated herein by reference.

The housing 102 can generally be circular in shape and can be connected to the drive shaft to rotate therewith during polishing. A vertical bore 120 may be formed through the housing 102, and five additional passages 122 (only two passages are illustrated) may extend through the housing 102 for pneumatic control of the carrier head. O-rings 124 may be used to form fluid-tight seals between the passages through the housing and passages through the drive shaft.

The base assembly 104 is a vertically movable assembly located beneath the housing 102. The base assembly 104 includes a generally rigid annular body 130, an outer clamp ring 134, and the gimbal mechanism 106. The gimbal mechanism 106 includes a gimbal rod 136 which slides vertically the along bore 120 to provide vertical motion of the base assembly 104, and a flexure ring 138 which bends to permit the base assembly to pivot with respect to the housing 102 so that the retaining ring 110 may remain substantially parallel with the surface of the polishing pad.

The loading chamber 108 is located between the housing 102 and the base assembly 104 to apply a load, i.e., a downward pressure or weight, to the base assembly 104. The vertical position of the base assembly 104 relative to the polishing pad is also controlled by the loading chamber 108. An inner edge of a generally ring-shaped rolling diaphragm 126 may be clamped to the housing 102 by an inner clamp ring 128. An outer edge of the rolling diaphragm 126 may be clamped to the base assembly 104 by the outer clamp ring 134.

The retaining ring 110 may be a generally annular ring secured at the outer edge of the base assembly 104. When fluid is pumped into the loading chamber 108 and the base assembly 104 is pushed downwardly, the retaining ring 110 is also pushed downwardly to apply a load to the polishing pad. A bottom surface 116 of the retaining ring 110 may be substantially flat, or it may have a plurality of channels to facilitate transport of slurry from outside the retaining ring to the substrate. An inner surface 118 of the retaining ring 110 engages the substrate to prevent it from escaping from beneath the carrier head.

The substrate backing assembly 112 includes a flexible membrane 140 with a generally flat main portion 142 and five concentric annular flaps 150, 152, 154, 156, and 158 extending from the main portion 142. The edge of the outermost flap 158 is clamped between the base assembly 104 and a first clamp ring 146. Two other flaps 150, 152 are clamped to the base assembly 104 by a second clamp ring 147, and the remaining two flaps 154 and 156 are clamped to the base assembly 104 by a third clamp ring 148. A lower surface 144 of the main portion 142 provides a mounting surface for the substrate 10.

The volume between the base assembly 104 and the internal membrane 150 that is sealed by the first flap 150 provides a first circular pressurizable chamber 160. The volume between the base assembly 104 and the internal membrane 150 that is sealed between the first flap 150 and the second flap 152 provides a second pressurizable annular chamber 162 surrounding the first chamber 160. Similarly, the volume between the second flap 152 and the third flap 154 provides a third pressurizable chamber 164, the volume between the third flap 154 and the fourth flap 156 provides a fourth pressurizable chamber 166, and the volume between the fourth flap 156 and the fifth flap 158 provides a fifth pressurizable chamber 168. As illustrated, the outermost chamber 168 is the narrowest chamber. In fact, the chambers 162, 164, 166 and 168 can be configured to be successively narrower.

Each chamber can be fluidly coupled by passages through the base assembly 104 and housing 102 to an associated pressure source, such as a pump or pressure or vacuum line. One or more passages from the base assembly 104 can be linked to passages in the housing by flexible tubing that extends inside the loading chamber 108 or outside the carrier head. Thus, pressurization of each chamber, and the force applied by the associated segment of the main portion 142 of the flexible membrane 140 on the substrate, can be independently controlled. This permits different pressures to be applied to different radial regions of the substrate during polishing, thereby compensating for non-uniform polishing rates caused by other factors or for non-uniform thickness of the incoming substrate.

To vacuum chuck the substrate, one chamber, e.g., the outermost chamber 168, is pressurized to force the associated segment of the flexible membrane 140 against the substrate 10 to form a seal. Then one or more of the other chambers located radially inside the pressurized chamber, e.g., the fourth chamber 166 or the second chamber 162, are evacuated, causing the associated segments of the flexible membrane 140 to bow inwardly. The resulting low-pressure pocket between the flexible membrane 140 and the substrate 10 vacuum-chucks the substrate 10 to the carrier head 100, while the seal formed by pressurization of the outer chamber 168 prevents ambient air from entering the low-pressure pocket.

Since it is possible for the vacuum-chucking procedure to fail, it is desirable to determine whether the substrate is actually attached to the carrier head. To determine whether the substrate is attached to the flexible membrane, the fluid control line to one of the chambers, e.g., the third chamber 164, is closed so that the chamber is separated from the pressure or vacuum source. The pressure in the chamber is measured after the vacuum-chucking procedure by a pressure gauge connected to the fluid control line. If the substrate is present, it should be drawn upwardly when the chamber 162 is evacuated, thereby compressing the third chamber 164 and causing the pressure in the third chamber to rise. On the other hand, if the substrate is not present, the pressure in the third chamber 164 should remain relative stable (it may still increase, but not as much as if the substrate were present). A general purpose computer connected to the pressure gauge can be programmed to use the pressure measurements to determine whether the substrate is attached to the carrier head. The chambers that are not used for sealing, vacuum-chucking or pressure sensing can be vented to ambient pressure.

Figure 2:
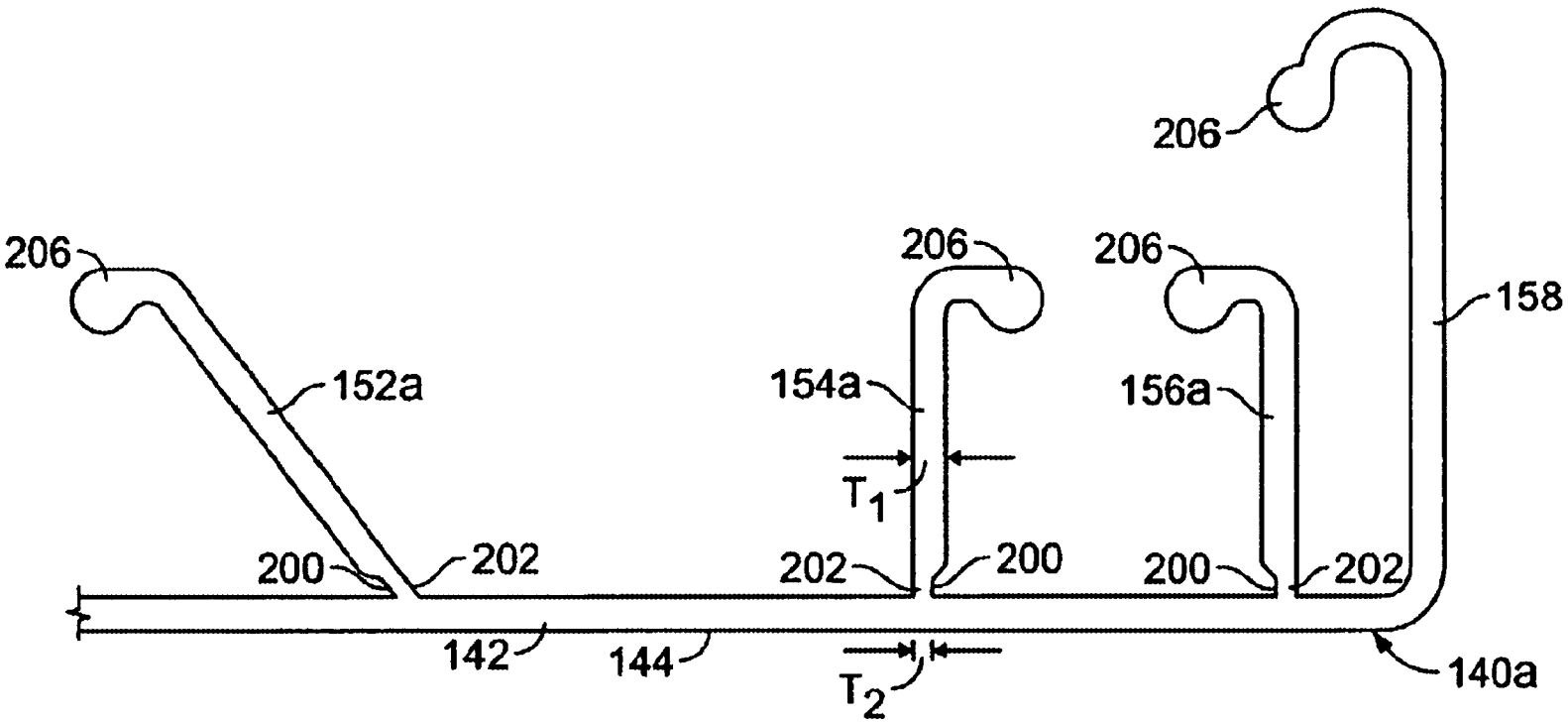
FIG. 2 is an enlarged view of a carrier head illustrating a flexible membrane with a notch in each flap.

Referring to FIG. 2, in one implementation, a notch or indentation 200 is formed in each of the annular flaps 150*a*, 152*a*, 154*a*, and 156*a*, except the outermost flap 158, of the flexible membrane 140*a* (flaps 150*a* is not shown in FIG. 2). Specifically, each notch 200 can be formed as an annular recess located immediately adjacent the main portion 142 of the flexible membrane 140*a*. Thus, the flaps 150*a*, 152*a*, 154*a* and 156*a* narrow (e.g., by a factor of about two) at the connection 202 to the main portion 142 of the flexible membrane 144*a*. For example, the thickness $T_1$ of the vertically extending portion 204 of the flap 154*a* may be about 1 mm, and the thickness $T_2$ of the flap 154*a* at the connection 202 may be about 0.5 mm. Each notch 200 can be formed on the same side of the flap as the rim 206 that is secured between the associated clamp ring and the base.

A potential advantage of the notches is to improve polishing uniformity when there is unequal pressure in adjacent chambers. Specifically, when there is unequal pressure in adjacent chambers, the pressure in the high pressure chamber tends to bow the separating flap into the low pressure chamber. For example, bending of the flap 150*a* at the connection 202 can lead to regions of compression in the main portion 142 adjacent the central flap 150*a*, resulting in an unintended pressure distribution and non-uniform polishing. However, the notch 200 makes the flap 150*a* more flexible at the connection 202. This reduces compression in the main portion 142 when the flap bends due to unequal pressure in chambers 160 and 162, thereby improving polishing uniformity.

Figure 3:
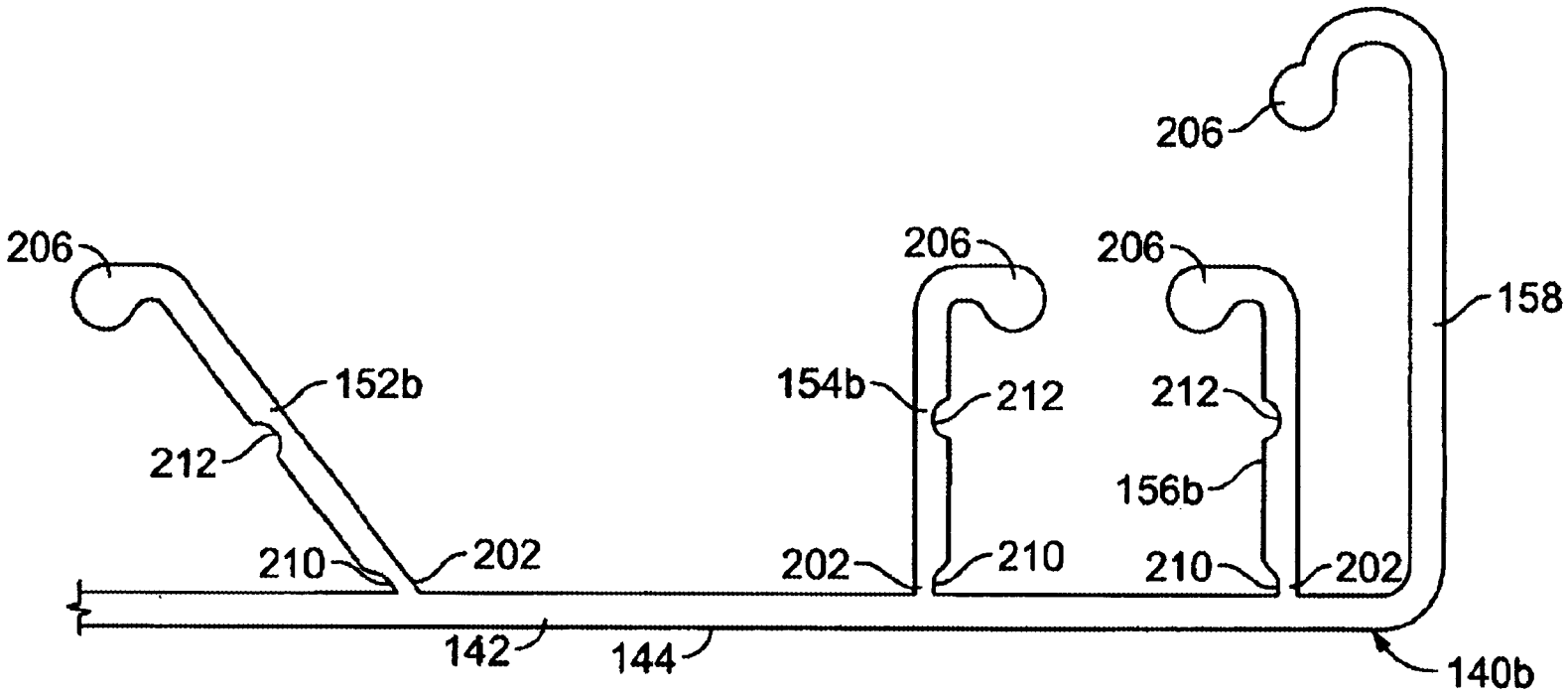
FIG. 3 is an enlarged view of a carrier head illustrating a flexible membrane with a multiple notches in each flap.

Referring to FIG. 3, in another implementation, each of the annular flaps 150*b*, 152*b*, 154*b* and 156*b*, includes three notches or indentations 210, 212 and 214. The first notch 210 is formed immediately adjacent the main portion 142 of the flexible membrane 140*b*, the second notch 212 is formed at about the midpoint of the A flap, and the third notch 214 is formed near the rim 206 of the flap. The second and third notches 212 and 214 further increases the flexibility of the flap, thereby further reducing the downward load on the substrate transmitted through the flexible membrane. Of course, implementations are possible with two notches, or four or more notches.

Figure 4A:
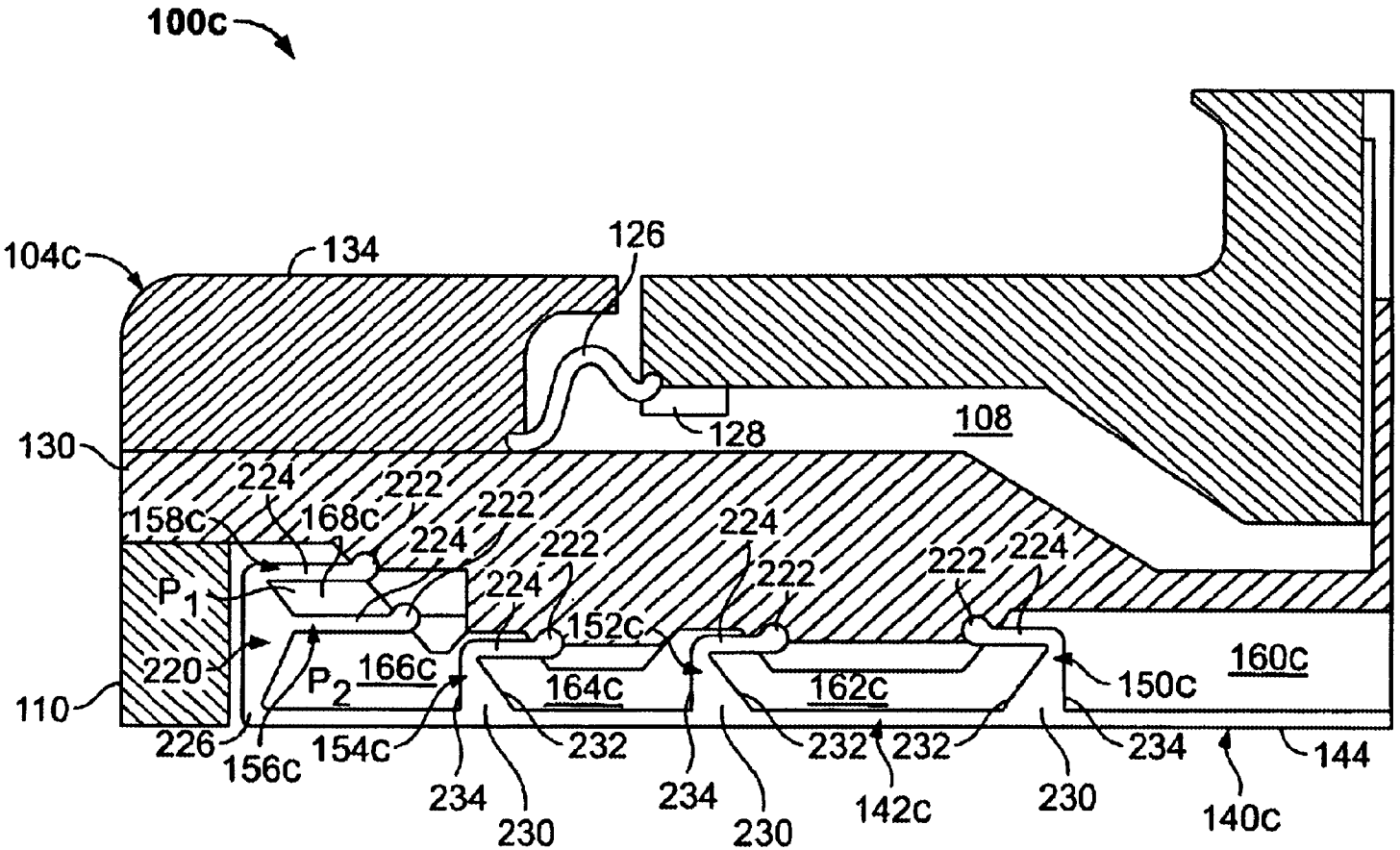
FIG. 4A is an enlarged view of a carrier head illustrating a flexible membrane with wide connection between each flap and the base portion of the membrane.

Referring to FIG. 4A, in another implementation, the flexible membrane 140*c* includes a main portion 142*c* and an outer portion 220 with a triangular cross-section connected to the outer edge of the main portion 142*c*. A lower surface 144 of the main portion 142*c* provides a mounting surface for the substrate 10. The three innermost annular flaps 150*c*, 152*c* and 154*c* are connected to the main portion 142*c* of the flexible membrane 140*c*. The two outermost annular flaps 156*c* and 158*c* are connected to the two vertices of the triangular outer portion 220. Each membrane flap 150*c*, 152*c*, 154*c*, 156*c* and 158*c* includes a thick rim 222 that is clamped between a clamp ring and the base, and a substantially horizontal portion 224 extending radially away from the rim 222. In the case of the two outermost annular flaps 156*c* and 158*c*, the horizontal portion 224 connects directly to the triangular outer portion 220. In the case of the three innermost annular flaps 150*c*, 152*c* and 154*c*, the horizontal portion 224 is connected to the main portion 142*c* by a thick wedge-shaped portion 230, also with a triangular cross-section. The wedge-shaped portion 230 can have sloped face 232 on the same side of the flap as the rim 206, and a generally vertical face 234 on the opposing side. In operation, when one of the chambers is pressurized or evacuated, the substantially horizontal portions 224 flex to permit the main portion 142*c* to move up or down.

A potential advantage of this membrane configuration is reduced resistance to vertical motion by different sections of the main portion of the 142*c* of the flexible membrane 140*c*. Another potential advantage of this membrane configuration is a uniform pressure distribution at low applied pressures or when there are uneven pressures in adjacent chambers. The wedge-shaped portion 230 generally prevents the membrane flap from bowing into the low-pressure chamber, thereby reducing or eliminating compressions in the main portion 142*c* that might result from bending of the flap. In addition, the thick wedge-shaped portion 230 distributes the downward load from the weight of the flap across a wide area on the substrate, thereby improving uniformity at low pressures.

Figure 4B:
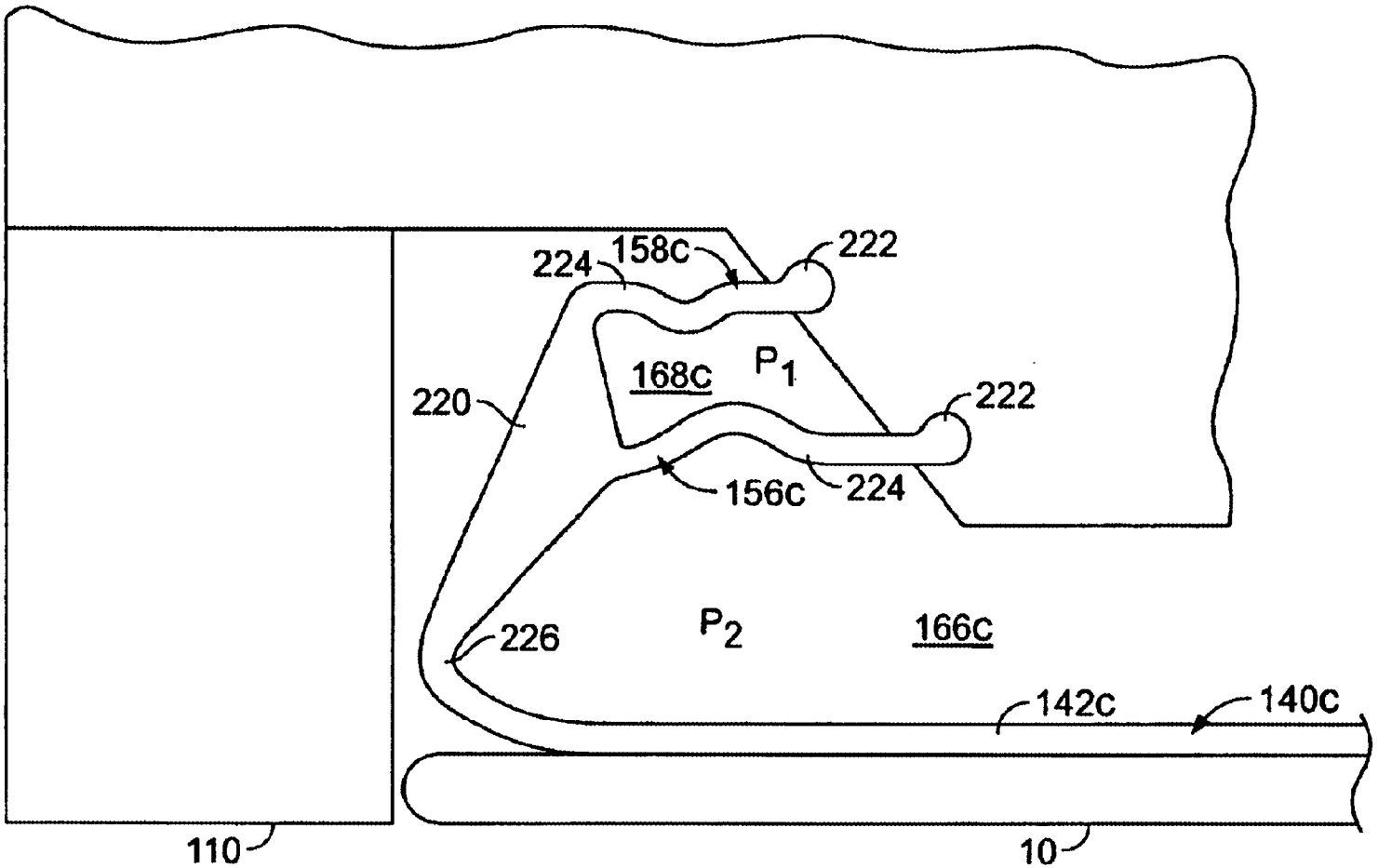
FIG. 4B is a view of the carrier head of FIG. 4A illustrating the motion of an outer portion of the flexible membrane.

The two outer chambers 166*c* and 168*c* can be used to control the pressure distribution on the outer perimeter of the substrate. If the pressure $P_1$ in the outermost chamber 168*c* is greater than the pressure $P_2$ in the second chamber 166*c*, the outer portion 224 of the flexible membrane 140*c* is driven downwardly, causing the lower vertex 226 the outer portion 224 to apply a load to the outer edge of the substrate. On the other hand, as shown in FIG. 4B, if the pressure $P_1$ in the outermost chamber 168*c* is less than the pressure $P_2$ in the second chamber 166*c*, the outer portion 224 pivots so that the lower vertex 226 is drawn upwardly. This causes the outer edge of the main portion 142*c* to be drawn upwardly and away from the perimeter portion of the substrate, thereby reducing or eliminating the pressure applied on this perimeter portion. By varying the relative pressures in the chambers 166*c* and 168*c*, the radial width of the section of the membrane pulled away from the substrate can also be varied. Thus, both the outer diameter of the contact area between the membrane and the substrate, and the pressure applied in that contact area, can be controlled in this implementation of the carrier head.

The configurations of the various elements in the carrier head, such as the relative sizes and spacings the retaining ring, the base assembly, or the flaps in the flexible membrane are illustrative and not limiting. The carrier head could be constructed without a loading chamber, and the base assembly and housing can be a single structure or assembly. The notches can be formed in other locations, the different flaps may have different numbers of notches, some of the flaps may be formed without notches, and there can be one or more notches on the outermost flap.

The present invention has been described in terms of a number of embodiments. The invention, however, is not limited to the embodiments depicted and described. Rather, the scope of the invention is defined by the appended claims.

What is claimed is:

1. A carrier head, comprising:

a housing to be secured to a drive shaft;

a base assembly;

a loading chamber controlling the position of the base assembly relative to the housing; a flexible membrane having a generally circular main portion with a lower surface that provides a substrate-mounting surface and a plurality of concentric annular flaps secured to the base assembly, the volume between the base assembly and the flexible membrane forming a plurality of pressurizable chambers; and a retaining ring joined to the base assembly;

wherein the carrier head includes five pressurizable chambers.

2. A carrier head, comprising:

a housing to be secured to a drive shaft;

a base assembly;

a loading chamber controlling the position of the base assembly relative to the housing; and a flexible membrane having a generally circular main portion with a lower surface that provides a substrate-mounting surface and a plurality of concentric flexible annular flaps secured to the base assembly, the volume between the base assembly and the flexible membrane forming a plurality of pressurizable chambers;

wherein at least one of the annular flaps includes a notch positioned and configured to reduce downward load transmitted from at least one of the chambers through the annular flap of the flexible membrane to the main portion so as to reduce compressions in the main portion.

3. The carrier head of claim 2, wherein the notch is formed at a juncture between the at least one annular flap and the main portion.

4. A carrier head, comprising:

a housing to be secured to a drive shaft;

a base assembly;

a loading chamber controlling the position of the base assembly relative to the housing; and a flexible membrane having a generally circular main portion with a lower surface that provides a substrate-mounting surface and a plurality of concentric annular flaps secured to the base assembly, the volume between the base assembly and the flexible membrane forming a plurality of pressurizable chambers;

wherein at least one of the annular flaps includes a widened section adjacent a juncture between the at least one annular flap and the main portion.

5. The carrier head of claim 4, wherein the at least one annular flap includes a horizontal portion extending from the base assembly to the widened section.

6. A carrier head, comprising:

a base assembly; and a flexible membrane having a generally circular main portion with a lower surface that provides a substrate-mounting surface and a plurality of concentric annular portions extending from the main portion and secured to the base assembly, the volume between the base assembly and the flexible membrane forming a plurality of pressurizable chambers, at least one of the annular portions including a notch positioned and configured to reduce downward load transmitted from at least one of the chambers through the annular portion of the flexible membrane to the main portion so as to reduce compressions in the main portion.

7. The carrier head of claim 6, wherein the notch is formed at a juncture between the at least one annular portion and the main portion.

8. A carrier head, comprising:

a base assembly; and a flexible membrane having a generally circular main portion with a lower surface that provides a substrate-mounting surface and a plurality of concentric annular portions extending from the main portion and secured to the base assembly, the volume between the base assembly and the flexible membrane forming a plurality of pressurizable chambers, at least one of the annular portions including a notch;

wherein a first notch of the plurality of notches is formed at a juncture between the at least one annular portion and the main portion and a second notch of the plurality of notches is formed at about a mid-point of the annular portion.

9. The carrier head of claim 8, wherein a first notch of the plurality of notches is formed at a juncture between the at least one annular portion and the main portion and a second notch of the plurality of notches is formed at about a mid-point of the annular portion.

10. A carrier head, comprising:

a base assembly; and a flexible membrane having a generally circular main portion with a lower surface that provides a substrate-mounting surface, an outer annular portion extending from an edge of the main portion and secured to the base assembly, and an inner annular portion extending from the main portion and secured to the base assembly, the volume between the base assembly and the flexible membrane forming a plurality of pressurizable chambers, the inner annular portion including a notch.

11. A carrier head, comprising:

a base assembly; and a flexible membrane having a generally circular main portion with a lower surface that provides a substrate-mounting surface, an outer annular portion extending from an edge of the main portion and secured to the base assembly, and an inner annular portion extending from the main portion and secured to the base assembly, the volume between the base assembly and the flexible membrane forming a plurality of pressurizable chambers, the inner annular portion including a widened section adjacent a juncture between the inner annular portion and the main portion, wherein the inner annular portion includes a horizontal portion extending from the base assembly to the widened section, and wherein the inner annular portion includes a rim section between the base assembly and the widened section.

12. The carrier head of claim 11, wherein the widened section includes a sloped face on a side closer to the rim, and a generally vertical face on a side opposite the rim.

13. The carrier head of claim 12, wherein the rim section is connected to a top vertex of the widened section.

14. A carrier head, comprising:

a base assembly; and a flexible membrane having a generally circular main portion with a lower surface that provides a substrate-mounting surface, an outer annular portion extending from an edge of the main portion, a first flap connected to a top vertex of the outer annular portion and secured to the base assembly, and a second flap connected to a second vertex of the outer annular portion and secured to the base assembly, the volume between the base assembly and the flexible membrane forming a plurality of pressurizable chambers.

15. A flexible membrane for use in a chemical mechanical polishing carrier head, comprising:

a generally circular main portion with a lower surface to provide a substrate-mounting surface;

an outer annular portion extending from an edge of the main portion to be secured to a base assembly of the carrier head; and an inner annular portion extending from the main portion to be secured to the base assembly, the inner annular portion including a notch.

16. A carrier head, comprising:

a housing to be secured to a drive shaft;

a base assembly;

a loading chamber controlling the position of the base assembly relative to the housing; and a flexible membrane having a generally circular main portion with a lower surface that provides a substrate-mounting surface and a plurality of flexible concentric annular flaps secured to the base assembly, the volume between the base assembly and the flexible membrane forming a plurality of pressurizable chambers;

wherein at least one of the annular flaps includes a notch adapted to allow the at least one of the annular flaps to flex when the pressure is unequal in adjacent pressurizeable chambers.

17. The carrier head of claim 16, wherein the notch is formed at a juncture between the at least one annular flap and the main portion.

18. A carrier head, comprising:

a base assembly; and a flexible membrane having a generally circular main portion with a lower surface that provides a substrate-mounting surface and a plurality of concentric annular portions extending from the main portion and secured to the base assembly, the volume between the base assembly and the flexible membrane forming a plurality of pressurizable chambers, at least one of the annular portions including a notch adapted to allow the at least one of the annular portions to flex when the pressure is unequal in adjacent pressurizeable chambers.

19. The carrier head of claim 18, wherein the notch is formed at a juncture between the at least one annular portion and the main portion.

20. A carrier head, comprising:

a base assembly; and a flexible membrane having a generally circular main portion with a lower surface that provides a substrate-mounting surface, an outer annular portion extending from an edge of the main portion and secured to the base assembly, and an inner annular portion extending from the main portion and secured to the base assembly, the volume between the base assembly and the flexible membrane forming a plurality of pressurizable chambers, the inner annular portion including a notch adapted to allow the inner annular portion to flex when the pressure is unequal in adjacent pressurizeable chambers.

21. A flexible membrane for use in a chemical mechanical polishing carrier head, comprising:

a generally circular main portion with a lower surface to provide a substrate-mounting surface;

an outer annular portion extending from an edge of the main portion to be secured to a base assembly of the carrier head; and an inner annular portion extending from the main portion to be secured to the base assembly, the inner annular portion including a notch adapted to allow the inner annular portion to flex.

22. A carrier head, comprising:

a base assembly; and a flexible membrane having a generally circular main portion with a lower surface that provides a substrate-mounting surface, an outer annular portion extending from an edge of the main portion and secured to the base assembly, and an inner annular portion extending from the main portion and secured to the base assembly, the volume between the base assembly and the flexible membrane forming a plurality of pressurizable chambers, the inner annular portion including a widened section adjacent a juncture between the inner annular portion and the main portion and a section extending generally parallel to the main portion that has a first edge joined to an apex of the widened section and a second edge secured to the base assembly.

23. A carrier head, comprising:

a housing to be secured to a drive shaft;

a base assembly;

a loading chamber controlling the position of the base assembly relative to the housing; and a flexible membrane having a generally circular main portion with a lower surface that provides a substrate-mounting surface and a plurality of concentric annular flaps secured to the base assembly, the volume between the base assembly and the flexible membrane forming a plurality of pressurizable chambers;

wherein at least one of the annular flaps includes a widened section adjacent a juncture between the at least one annular flap and the main portion, and wherein the widened section stiffens the annular flap allowing it to resist bowing when there is unequal pressure in adjacent pressurizable chambers.

24. The carrier head of claim 23, wherein the at least one annular flap includes a horizontal portion extending from the base assembly to the widened section.

25. A carrier head, comprising:

a base assembly; and a flexible membrane having a generally circular main portion with a lower surface that provides a substrate-mounting surface, an outer annular portion extending from an edge of the main portion and secured to the base assembly, and an inner annular portion extending from the main portion and secured to the base assembly, the volume between the base assembly and the flexible membrane forming a plurality of pressurizable chambers, the inner annular portion including a widened section adjacent a juncture between the inner annular portion and the main portion, wherein the widened section stiffens the inner annular portion allowing it to resist bowing when there is unequal pressure in adjacent pressurizable chambers, wherein the inner annular portion includes a rim section between the base assembly and the widened section.

26. The carrier head of claim 25, wherein the widened section includes a sloped face on a side closer to the rim, and a generally vertical face on a side opposite the rim.

27. The carrier head of claim 26, wherein the rim section is connected to a top vertex of the widened section.

* * * * *